US005349704A

United States Patent [19]

Masters

[11] Patent Number: 5,349,704

[45] Date of Patent: Sep. 27, 1994

[54] FOOTBALL JERSEY WITH TAILORED SLEEVE

[75] Inventor: Charles Masters, Cookeville, Tenn.

[73] Assignee: Wilson Sportiong Goods Co., Chicago, Ill.

[21] Appl. No.: 56,504

[22] Filed: May 3, 1993

[51] Int. Cl.[5] ..... A41B 1/00; A41D 27/00; A41D 27/10

[52] U.S. Cl. ..... 2/115; 2/113; 2/125; 2/243.1

[58] Field of Search ..... 2/69.69.5, 93, 75, 80, 2/115, 125, 126, 105, 106, 108, 243 R, 243 B, 113, 115, 112, 114, 243.1, 90; 446/28

[56] References Cited

U.S. PATENT DOCUMENTS

| | | | |
|---|---|---|---|
| 2,094,643 | 10/1937 | Fellroth | 2/115 |
| 3,561,009 | 2/1971 | Huggins | 2/90 |
| 4,195,362 | 4/1980 | Rolando | 2/108 |
| 4,698,849 | 10/1987 | Mitchell et al. | 2/115 |
| 4,937,883 | 7/1990 | Shirai | 2/113 X |
| 4,939,844 | 7/1990 | Fujimura | 2/115 X |

*Primary Examiner*—Jeanette E. Chapman

[57] ABSTRACT

A football jersey is provided with sleeves and arm openings which provide a tight fit around the arms of a player. Each arm opening extends through both a sleeve and a side portion of the jersey. A portion of the arm opening is defined by a free edge of the sleeve and a portion of the arm opening is defined by a free edge of the side portion of the jersey.

10 Claims, 4 Drawing Sheets

Fig. 1
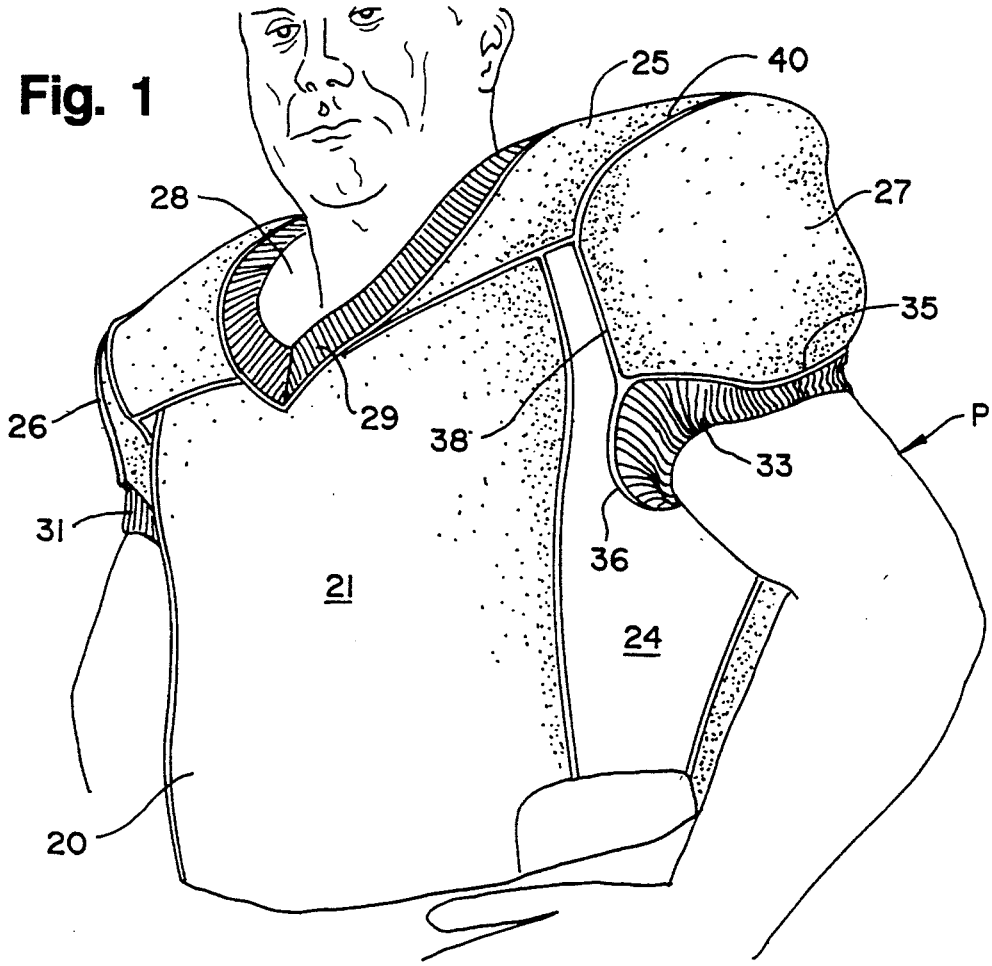
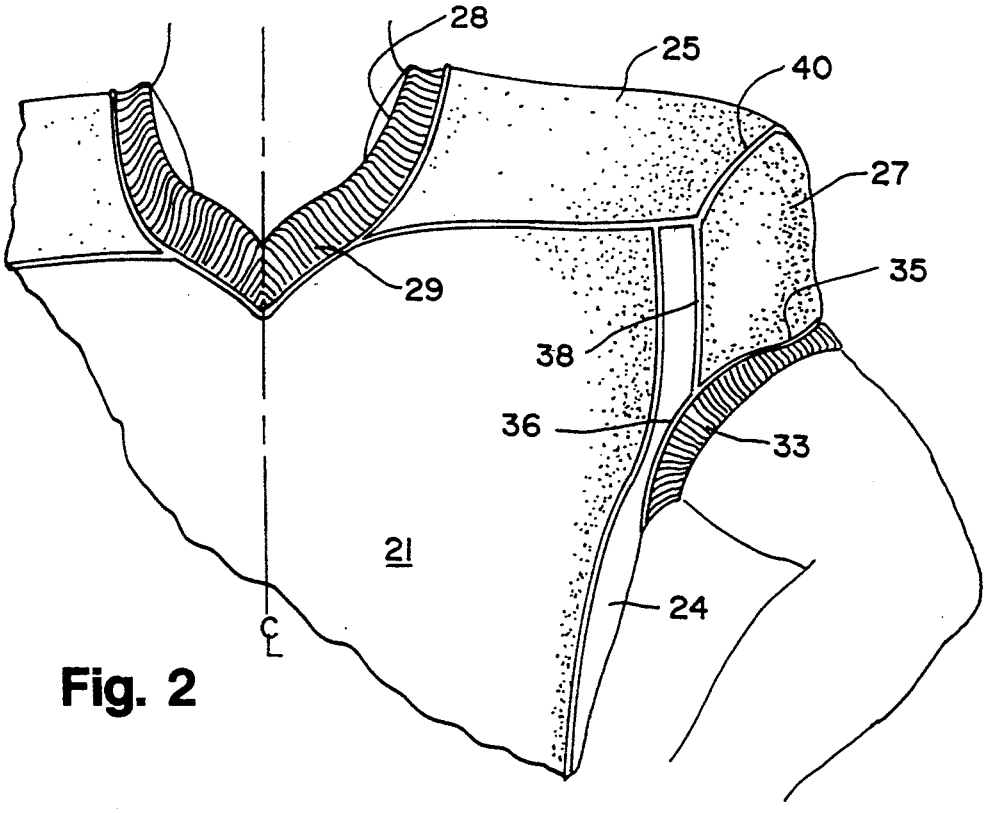
Fig. 2

Fig. 3
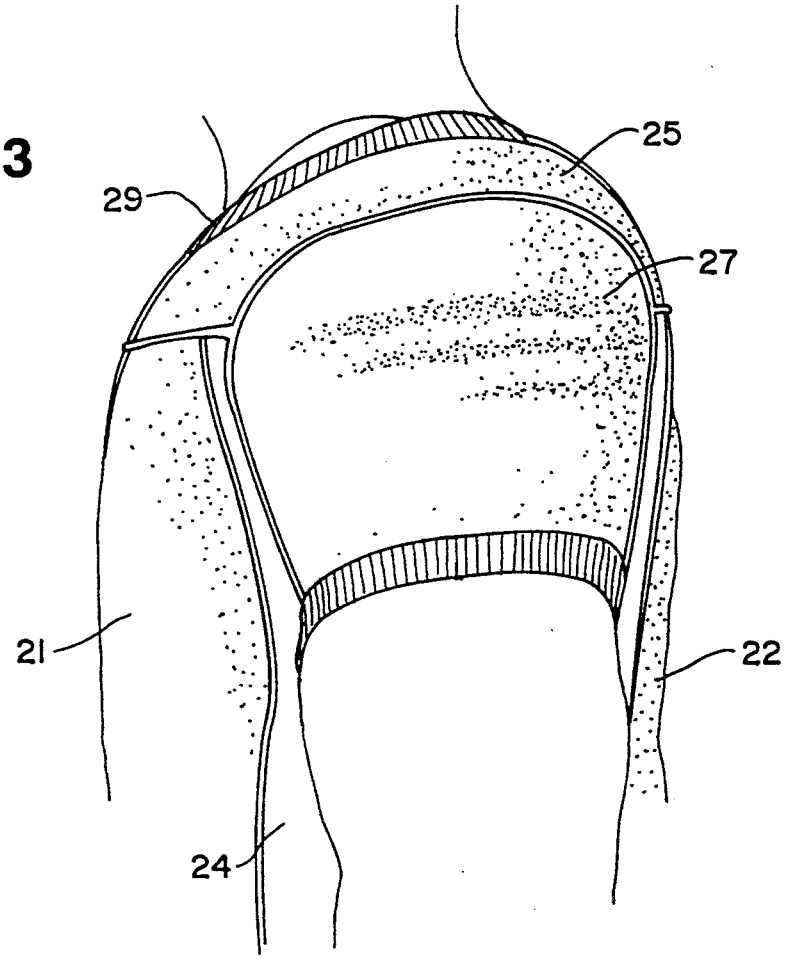
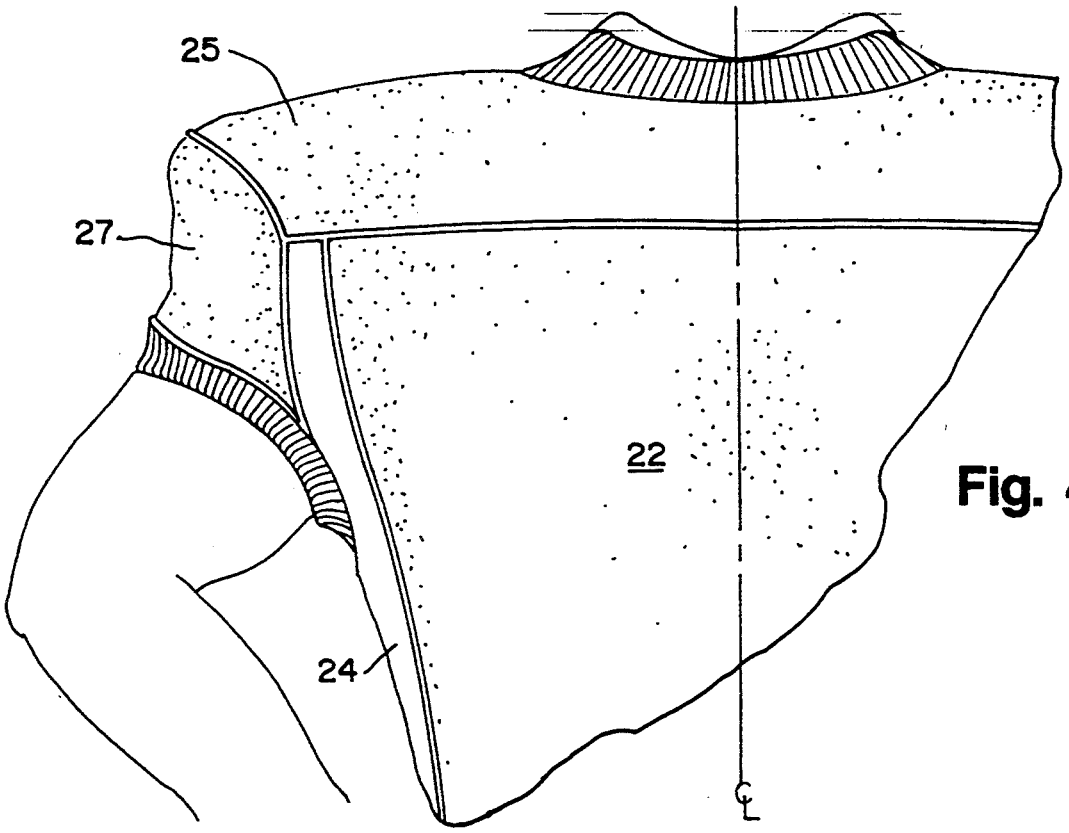
Fig. 4

Fig. 8
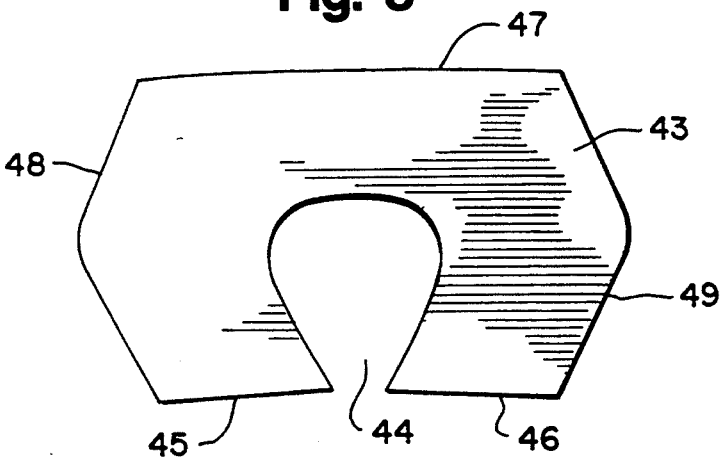
Fig. 11
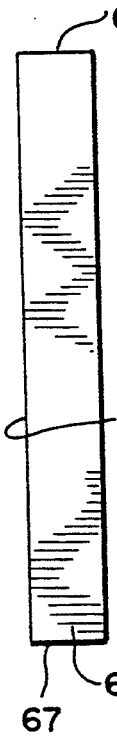
Fig. 10
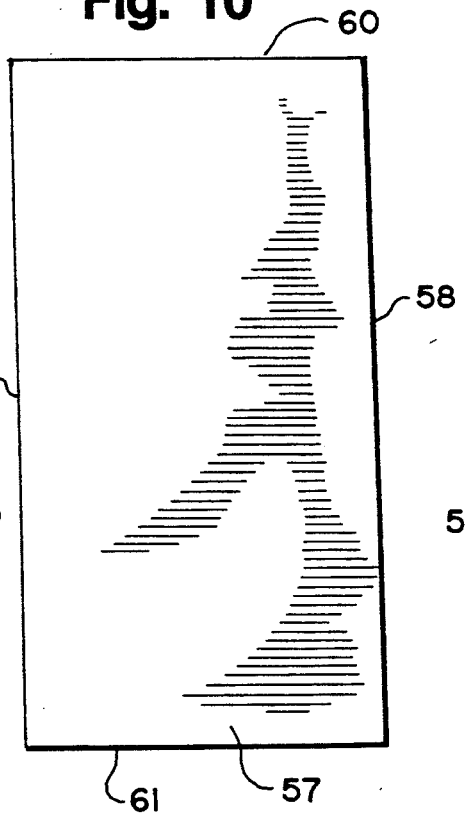
Fig. 9
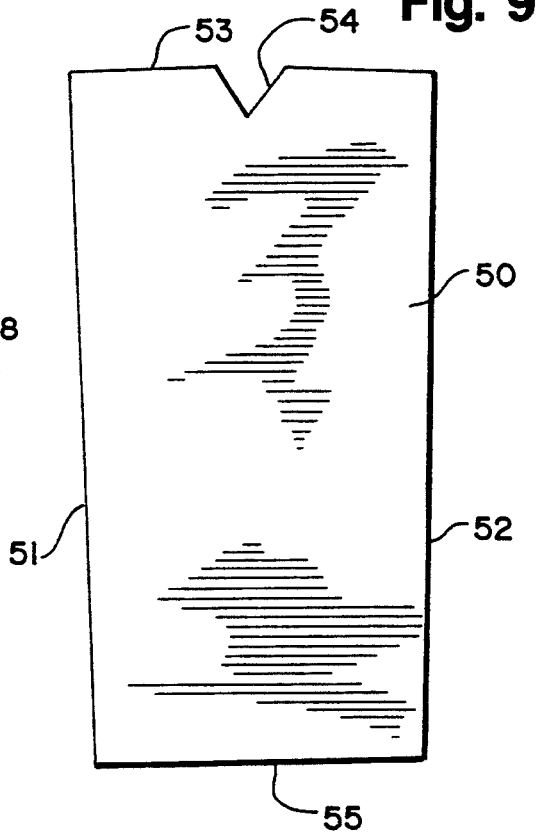
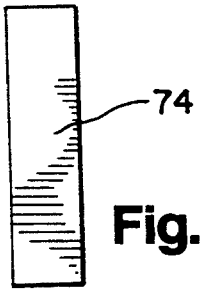
Fig. 12
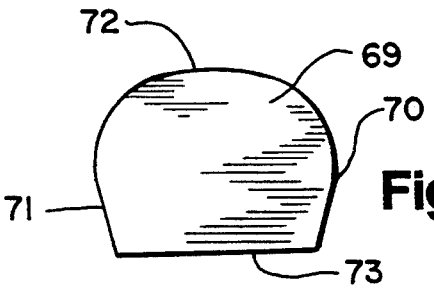
Fig. 13

FOOTBALL JERSEY WITH TAILORED SLEEVE

BACKGROUND

This invention relates to football jerseys, and, more particularly, to a football jersey which is provided with specially tailored sleeves which fit snugly about the arms with any excess material.

Many football players, particularly linemen, want to wear their jerseys as tightly as possible to minimize the opportunity for an opponent to hold onto the jersey. The main portion of the jersey can be worn tightly about the player simply by using a smaller jersey size and by forming a portion of the jersey from elastic or expandable material.

The biggest problem occurs in the sleeve area. The football lineman wears shoulder pads which are substantially bigger than the shoulder pads which are worn by players in other positions. The sleeve area must be big enough to fit over the shoulder pads, but the sleeve should fit tightly around the arm below, the shoulder pad so that excess, loose material is not present.

Many players and equipment managers have gone to the trouble of "custom tailoring" their jerseys by taping excess sleeve material under the arms or by cutting away some of the sleeve material and then stitching or taping the sleeve after the jersey is donned.

The foregoing "custom tailoring" not only requires a considerable period of time before each game, but tailoring the jerseys can cause the jerseys to lose their uniform look. For example, colored stripes or logos are often worn on the sleeves of team jerseys, and the stripes or logos can be stretched, distorted, or obscured by the tailoring.

SUMMARY OF THE INVENTION

The invention provides a machine-produced jersey with tailored sleeves which fit over a lineman's shoulder pads but which fit tightly around the arms. The tight fit is accomplished by using a sleeve which is not cylindrical so that the arm opening is provided in both the sleeve and the side portion of the jersey rather than in only the sleeve.

DESCRIPTION OF THE DRAWING

The drawing will be explained in conjunction with an illustrative embodiment shown in the accompanying drawing, in which FIG. 1 is a fragmentary perspective view of a football player wearing a jersey formed in accordance with the invention;

FIG. 2 is a fragmentary front view of the player;

FIG. 3 is a fragmentary side view of the player;

FIG. 4 is a fragmentary back view of the player;

FIG. 8 is a plan view of the pattern for the shoulder portion of the jersey;

FIG. 9 is a plan view of the pattern for the front panel of the jersey;

FIG. 10 is a plan view of the pattern for the back panel of the jersey;

FIG. 11 is a plan view of the pattern for the side panels of the jersey;

FIG. 12 is a plan view of the pattern for the arm cuffs of the jersey; and

FIG. 13 is a plan view of the pattern for the sleeves of the jersey.

DESCRIPTION OF SPECIFIC EMBODIMENT

Figure 5:
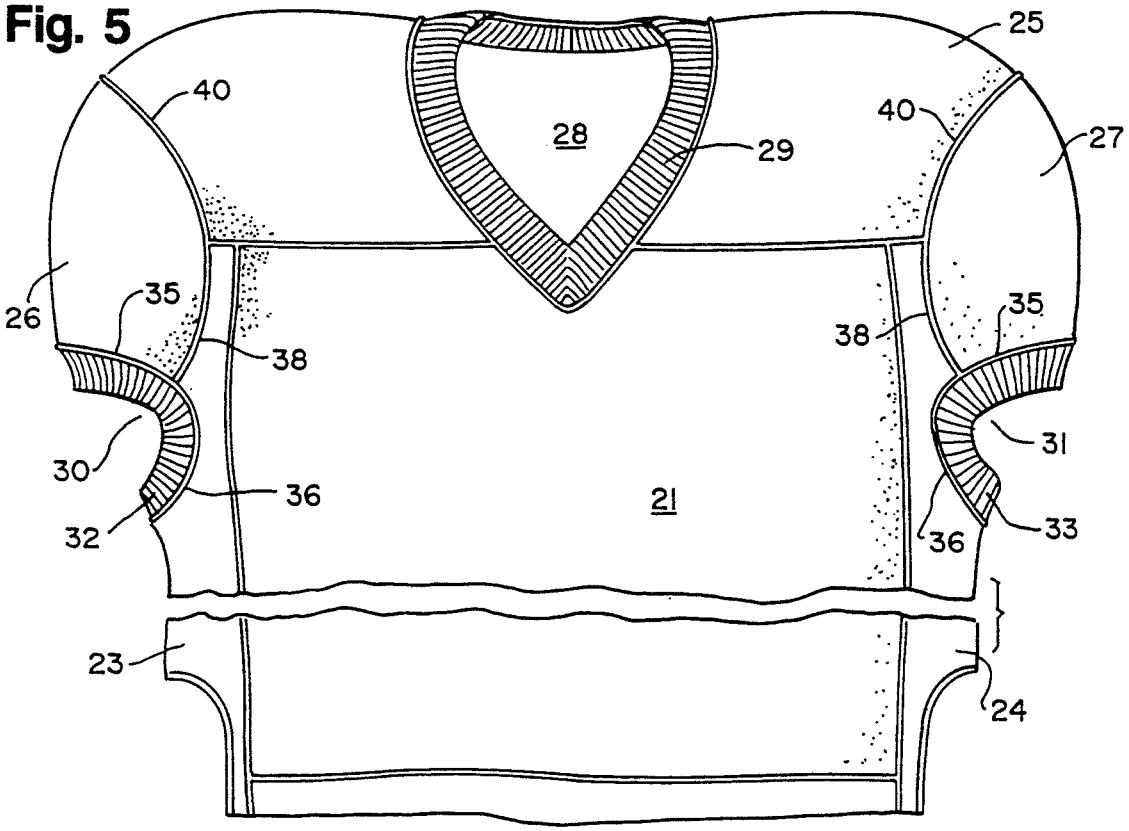
FIG. 5 is a fragmentary front view of the jersey.

FIGS. 1–4 illustrate a football player P wearing a football jersey 20. The football player is wearing conventional football shoulder pads, and the jersey is sized to fit snugly over the pads and around the player's torso.

The jersey includes a front panel 21 which covers the stomach and chest of the player, a back panel 22, right and left side panels 23 and 24, shoulder panel 25, and right and left sleeves 26 and 27. The shoulder panel is provided with a neck opening 28, and a cuff 29 is attached to the shoulder panel and to the top central portion of the front panel. Right and left arm openings 30 and 31 are provided, respectively, through the right sleeve 26 and right panel 23 and through the left sleeve 27 and left panel 24. An arm cuff 32 is attached to the right sleeve and right panel around the right arm opening, and an arm cuff 33 is attached to the left sleeve and left panel around the left arm opening.

Conventional sleeves are cylindrical and include a circular free or end edge which completely encircles the arm and provides an arm opening. In contrast to a conventional sleeve, the sleeves 26 and 27 are not cylindrical and do not include a circular free or end edge. Instead, each sleeve includes a free edge 35 (FIGS. 5–7) at the bottom of the sleeve, and the free edge forms only a portion of the arm opening. The remainder of the arm opening is provided by a free edge 36 of each side panel. The free edge 35 of the sleeve and the free edge 36 of the side panel merge to form the arm opening. As used herein, the term "free edge" means that the edge is not attached to adjacent panels of the jersey, for example, the front, back, and shoulder panels. The free edge 36 of the side panel is U-shaped or semi-circular and curves downwardly from the free edge of the sleeve. In the embodiment illustrated, the free edges which form the arm openings are attached to the cuffs 32 and 33.

Each of the sleeves includes front side edges 38 and back side edges 39 which are attached to the adjacent side panel and a curved top edge 40 which is attached to the shoulder panel. The sleeve thereby fits tightly over the shoulder pad, and the sleeve does not include the conventional loose, cylindrical end portion which is not attached directly to the side portion and which can provide a handhold for an opposing player. The arm cuffs are preferably formed of elastic or expandable material so that the cuff fits tightly around the arm and draws the free edges of the sleeve and side panel toward the arm.

The side panels 23 and 24 are also preferably formed from elastic or stretchable material, for example, Spandex. The elastic side panels enable the front and back panels and the sleeves to separate enough to be pulled over the shoulder pads when the jersey is donned by the player and then pull the front and back panels tightly about the player's torso and pull the sleeves tightly against the shoulder pads and arms when the jersey is pulled downwardly.

Because the sleeves are not cylindrical and do not encircle the arms, the sleeves and the other parts of the jersey can be formed from flat pieces of fabric. FIGS. 8–13 illustrate flat patterns which are used to cut the material for the jersey. The patterns can be formed from paper or stiffer material such as fiberboard.

FIG. 8 illustrates the pattern 43 for the shoulder panel 25. A flat piece of jersey fabric is cut in the shape of the pattern to provide the shoulder panel. The pattern has a neck opening 44, front edges 45 and 46 which form the portions of the shoulder panel which are sewn or stitched to the front panel, back edge 47 which forms the portion of the shoulder panel which is stitched to the back panel, and side edges 48 and 49 which form the portion of the shoulder panel which is stitched to the sleeves.

FIG. 9 illustrates the pattern 50 for the front panel 21. The pattern includes right and left side edges 51 and 52, top edge 53 which is provided with a notch 54 for part of the V-shaped neck opening, and bottom edge 55.

FIG. 10 illustrates the pattern 57 for the back panel 22. The panel includes right and left side edges 58 and 59 and top and bottom edges 60 and 61.

FIG. 11 illustrates the pattern 63 for the side panels 23 and 24. The pattern includes front and back edges 64 and 65 and top and bottom edges 66 and 67. After each side panel is cut, the curved free edge for the arm opening is cut in the top of the panel.

Figure 6:
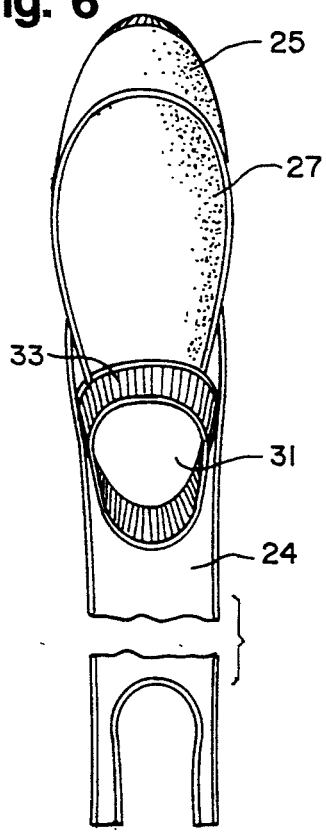
FIG. 6 is a fragmentary right side view of the jersey.
Figure 7:
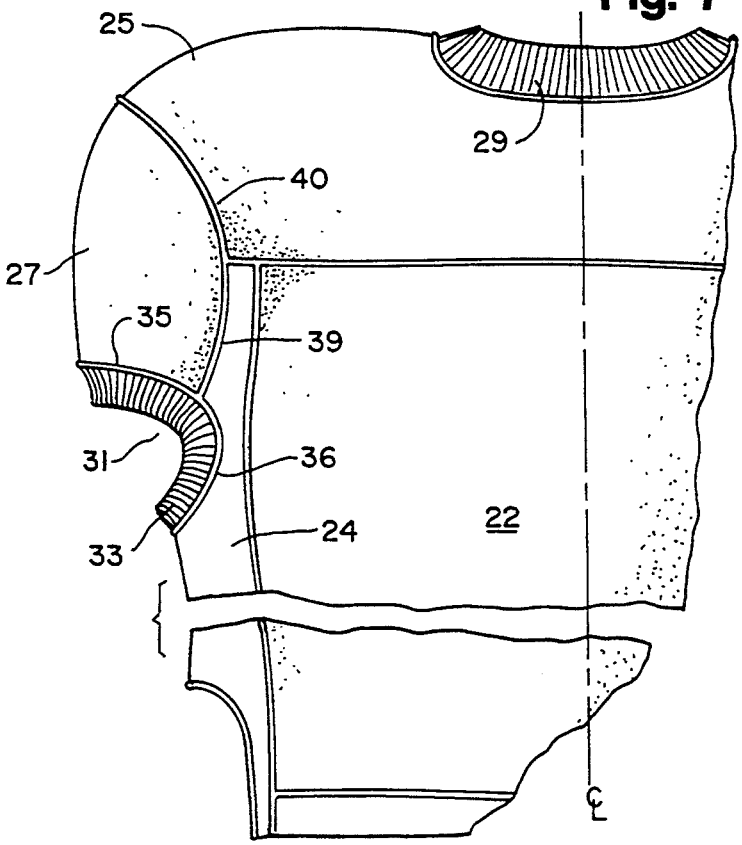
FIG. 7 is a fragmentary back view of the jersey.

FIG. 13 illustrates the pattern 69 for the sleeves. The pattern includes front and back side edges 70 and 71, curved top edge 72, and a straight bottom or free edge 73. The edges 70-72 of the pattern correspond to the edges 38-40 of the sleeves, and the straight edge 73 of the pattern corresponds to the free edge 35 of the sleeve. When the flat piece of material for the sleeve is stitched or sewn to the side panel and shoulder panel, the sleeve assumes a convex or pocket shape, and the free edge 35 becomes curved as shown in FIGS. 5–7.

FIG. 12 illustrates the pattern 74 for the arm cuffs 33. A similar pattern is used for the neck cuff 29.

While in the foregoing specification a detailed description of specific embodiments of the invention were set forth for the purpose of illustration, it will be understood that many of the details herein given may be varied considerably by those skilled in the art without departing from the spirit and scope of the invention.

I claim:

1. A football jersey adopted to be worn over shoulder pads comprising:

a front panel adapted to cover the front torso of a wearer, a back panel adapted to cover the back torso of a wearer, right and left side panels extending between the front and back panels and adapted to cover the side torso of a wearer, the front panel, back panel, and said panels forming a tubular enclosure for the torso of a wearer, right and left shoulder portions extending between the front and back panels and adapted to extend over the shoulder pads, a right sleeve extending outwardly from the right shoulder portion and the right side panel, a left sleeve extending outwardly from the left shoulder portion and the left side panel, each of the sleeves having a free edge which is not attached to the shoulder portions or side panels, each of the side panels having an upper portion which is located between the front and back panels and which does not extend outwardly beyond the tubular enclosure so that the side panel does not extend outwardly below the arm of a wearer, the upper portion of each side panel having a free edge portion which is not connected to the front panel, back panel, or shoulder portions and which is adapted to extend along the side torso of a wearer from adjacent the front panel to adjacent the back panel, the free edge of the right sleeve cooperating with the free edge portion of the right side panel to form a right arm opening and the free edge of the left sleeve cooperating with the free edge portion of the left side panel to form a left arm opening, whereby the jersey will fit tightly below the arms of a wearer without any excess material of the side panels extending below the arms of a wearer.

2. The jersey of claim 1 including a generally circular cuff attached to the free edge of each sleeve and to the free edge portion of the adjacent side panel.

3. The jersey of claim 2 in which each of the cuffs is formed from elastic material.

4. The jersey of claim 1 in which the free edge portion of each of the side panels curves downwardly from the free edge of the adjacent sleeve.

5. The jersey of claim 1 in which each of said panels and each of said sleeves is formed from a flat piece of material which is stitched to the adjacent panels.

6. A football jersey adopted to be worn over shoulder pads comprising:

a front panel adapted to cover the front torso of a wearer and having right and left side portions and a top portion, a back panel adapted to cover the back torso of a wearer and having right and left side portions and a top portion, a right side panel adapted to cover the right side torso of a wearer and extending between the right side portions of the front and back panels, the right side panel having an upper portion which is located between the front and back panels and which has a free edge portion which is not connected to the front and back panels and which is adapted to extend along the side torso of a wearer from adjacent the front panel to adjacent the back panel, a left side panel adapted to cover the left side torso of a wearer and extending between the left side portions of the front and back panels, the left side panel having an upper portion which is located between the front and back panels and which has a free edge portion which is not connected to the front and back panels and which is adapted to extend along the side torso of a wearer from adjacent the front panels to adjacent the back panel, the front panel, back panel, and side panels forming a tubular enclosure for the torso of a wearer and the upper portions of the side panels do not extend outwardly beyond the tubular enclosure so that the side panels do not extend outwardly below the arm of a wearer, a top panel extending between the top portions of the front and back panels and having a neck opening, a right sleeve connected to the right side panel and the top panel, the right sleeve having a bottom free edge which cooperates with the free edge portion of the right side panel to form a right arm opening, and a left sleeve connected to the left side panel and the top panel, the left sleeve having a bottom free edge which cooperates with the free edge portion of the left side panel to form a left arm opening, whereby the jersey will fit tightly below the arms of a wearer without any excess material of the side panels extending below the arms of a wearer.

7. The jersey of claim 6 including a generally circular right cuff attached to the free edge of the right sleeve and the free edge portion of the right side panel and a generally circular left cuff attached to the free edge of the left sleeve and the free edge portion of the left side panel.

8. The jersey of claim 7 in which each of the cuffs is formed from elastic material.

9. The jersey of claim 6 in which each of said panels and each of said sleeves is formed from a flat piece of material which is stitched to the adjacent panels.

10. The jersey of claim 6 in which each of the free edge portions of the right and left side panels curves downwardly from the bottom free edge of the right and left sleeve, respectively.

* * * * *

UNITED STATES PATENT AND TRADEMARK OFFICE

CERTIFICATE OF CORRECTION

PATENT NO. : 5,349,704

DATED : September 27, 1994

INVENTOR(S) : Charles Masters

It is certified that error appears in the above-indentified patent and that said Letters Patent is hereby corrected as shown below:

Col. 3, line 51 change "said" to —side—.

Signed and Sealed this

Twenty-first Day of February, 1995

*Attest:*

Bruce Lehman

BRUCE LEHMAN

*Attesting Officer*

*Commissioner of Patents and Trademarks*